United States Patent [19]

Brasell et al.

[11] Patent Number: 4,576,542

[45] Date of Patent: Mar. 18, 1986

[54] DEVICE FOR LIFTING REMOVABLE AUTOMOBILE TOPS

[76] Inventors: James M. Brasell, 20515 Marilyn La., Spring, Tex. 77388; Ernest Nichols, Jr., 11610 Taylorcrest, Houston, Tex. 77024

[21] Appl. No.: 603,153

[22] Filed: Apr. 23, 1984

[51] Int. Cl.[4] ..... B66C 1/62

[52] U.S. Cl. ..... 414/626; 294/67.1; 294/67.3

[58] Field of Search ..... 414/227, 261, 266, 267, 414/592, 618, 626, 785, 787; 294/67 R, 67 B, 67.1, 67.3; 248/489, 492, 493, 328; 254/47

[56] References Cited

U.S. PATENT DOCUMENTS 1,040,177 10/1912 Etmian ..... 254/47

1,649,904 11/1927 Longgood ..... 294/67 R

*Primary Examiner*—Robert G. Sheridan

*Attorney, Agent, or Firm*—Neal J. Mosely

[57] ABSTRACT

A device for lifting removable tops from vehicles comprises a frame having a longitudinal member attached to a hoist and upper and lower crossbars extending laterally outward therefrom to envelope the vehicle top. Protective pads on each end of the lower crossbar engage the underside of the top near the rear portion and a protective pad at the front of the longitudinal member engages the front topside of the top whereby the removable top is supported in a balanced horizontal position upon application of a lifting force to the longitudinal member.

20 Claims, 6 Drawing Figures

DEVICE FOR LIFTING REMOVABLE AUTOMOBILE TOPS

BACKGROUND OF THE INVENTION

1. Field of the Invention

This invention relates to hoist mechanisms, and more particularly to a device for lifting a removable top of an automobile.

2. Brief Description of the Prior Art

Hoist mechanisms and vehicle lifting apparatus are known in the art. There are several patents disclosing various vehicle lifting devices which are directed to elevating the entire vehicle body.

Lowe, U.S. Pat. No. 307,864 discloses a device for lifting wagon bodies which comprises a pair of T-shaped cross pieces provided with tackles and pendent hooks. The cross pieces are movably suspended on cords passing through the tackles and through pulleys disposed in an H-shaped crane and are operated by a windlass.

Gordon, U.S. Pat. No. 617,828 discloses a lifting apparatus used to elevate wagon boxes and hay racks. The apparatus comprises a plurality of aligned support posts each having a pulley which carries a lift rope having a hook at one end and the other end connected to a windlass which is slidably mounted on a guide beam disposed between the support posts. A clamp device attached to the hook encompasses the wagon body for supporting it when lifting.

Stone, U.S. Pat. No. 1,178,829 discloses a device for removing a vehicle body from the chassis. The device comprises adjustable supporting arms movably connected to a cross piece and adapted to engage the vehicle body.

Folkers, U.S. Pat. No. 1,484,389 discloses a hay rack and wagon box lifter comprising an open frame having corner posts and a cross bar provided with a pair of pulleys. A horizontal shaft mounted between the corner posts is rotated by means of a vertical shaft connected thereto at one end by a bevel gear arrangement. A pair of cables passing through the pulleys are attached at one end to the horizontal shaft to be wound thereon and their other ends are provided with hooks which receive a rectangular bar which is positioned beneath the wagon body for lifting.

Longgood, U.S. Pat. No. 1,649,904 discloses a vehicle crane sling for lowering a vehicle body onto the vehicle chassis. The sling comprises a longitudinal rectangular frame member and a perpendicular crossmember connected thereto at one end which has downwardly projecting arms pivotally connected thereon. A pair of chains and hooks are connected at the opposed end of the frame member to be attached to the front vehicle cowling, and a pair of padded blocks on the arms fit into the vehicle wheel wells to support the weight of the vehicle. A movable block on the frame member attaches to a lifting crane and is adjustable longitudinally to compensate for various centers of gravity. A spring biased padded arm extending from the frame member engages the front of the vehicle top, and padded brackets contact the side rails of the top to prevent longitudinal and transverse rocking of the vehicle.

The prior art does not disclose a lifting device for lifting removable tops from vehicles as described and claimed below.

SUMMARY OF THE INVENTION

One object of the invention is to provide a device fo: lifting a removable top from an automobile or the like Another object of the invention is to provide a liftin device for lifting removable tops from vehicles havin frame components to support the removable top in balanced horizontal position on lifting the frame.

Another object of the invention is to provide a liftin device having protective support members to suppor the weight of a removable vehicle top during lifting lowering, and storage operations without damage to th inner or outer surface of the top.

Another object of the invention is to provide a liftin device having suspension means for safely and conve- niently storing a removable vehicle top and the devic when not in use.

Another object of the invention is to provide a hoist means having a worm gear drive winch mechanism tc prevent the top from dropping to the ground.

Another object of the invention is to provide a lift device which is simple and efficient in operation and economical to manufacture.

Other objects of the invention will become apparent from time to time throughout the specification and claims as hereinafter related.

These objects and other objects of the invention are accomplished by a device for lifting removable tops from vehicles comprising a frame attachable to the vehicle top in a manner to distribute the weight of the vehicle top upon application of an upward force to the frame to balance the top in a horizontal position during raising and lowering operation.

DESCRIPTION OF THE PREFERRED EMBODIMENT

Figure 1:
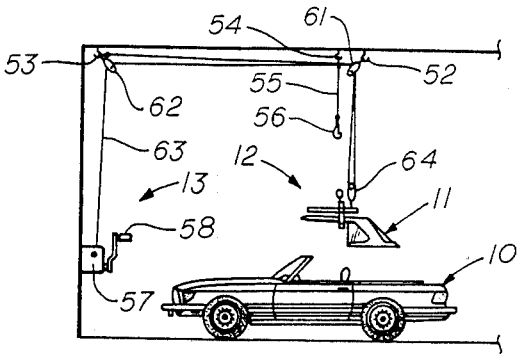
FIG. 1 is a view in side elevation of a lifting device in accordance with the present invention being used to lift a removable top from an automobile.

Referring to the drawings by numerals of reference, and particularly to FIG. 1, there is shown an automobile 10 of the type having a removable top 11. The top 11 is shown being lifted by a preferred lifting device 12, which is raised and lowered by hoisting means 13. Once lifted, the top 11 and lifting device 12 may be suspended by safety cables from hooks secured to the ceiling of the garage for safe, convenient, and easily accessable storage.

Figure 2:
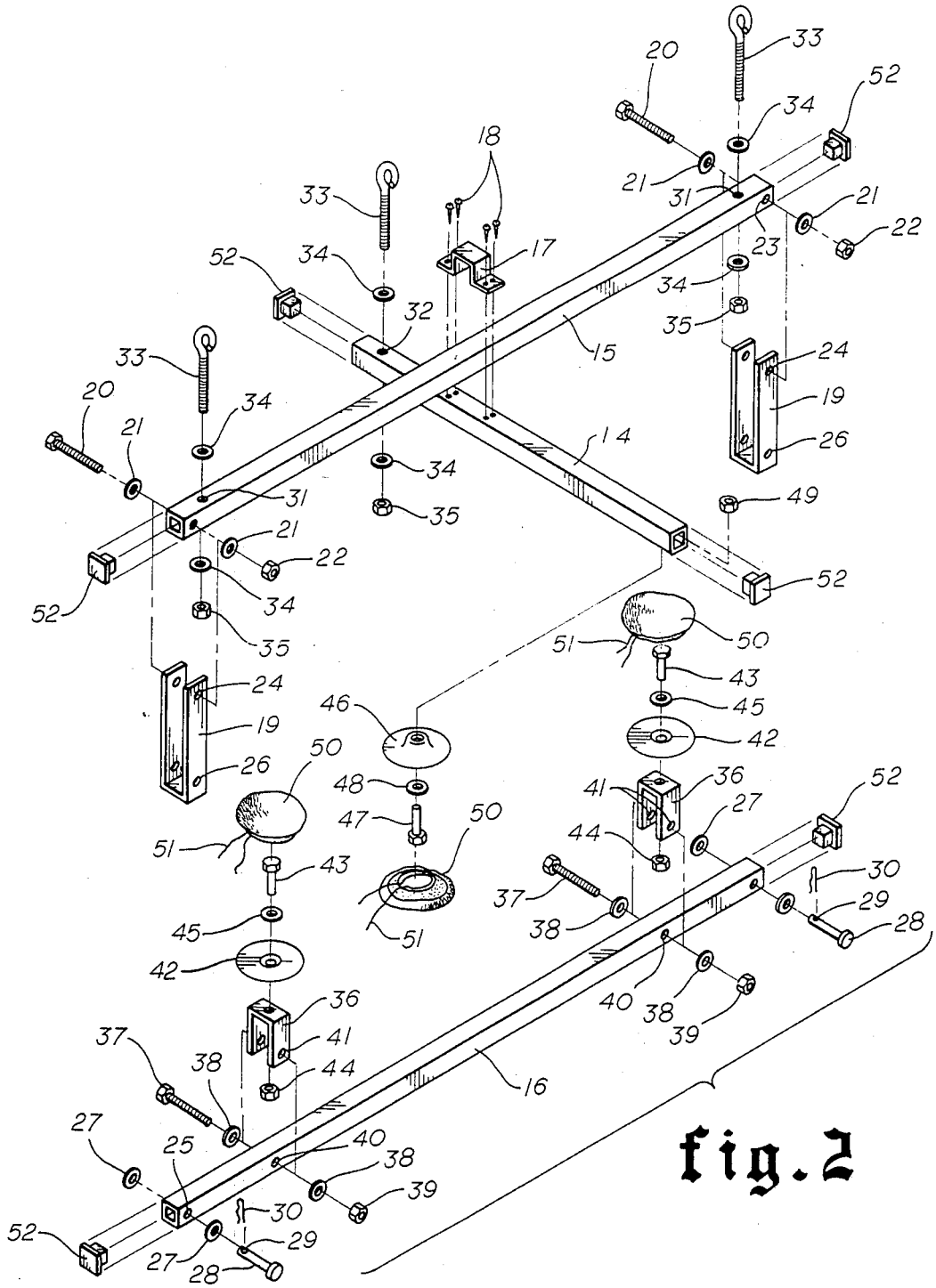
FIG. 2 is an exploded isometric view showing the components of the lifting device.
Figure 3:
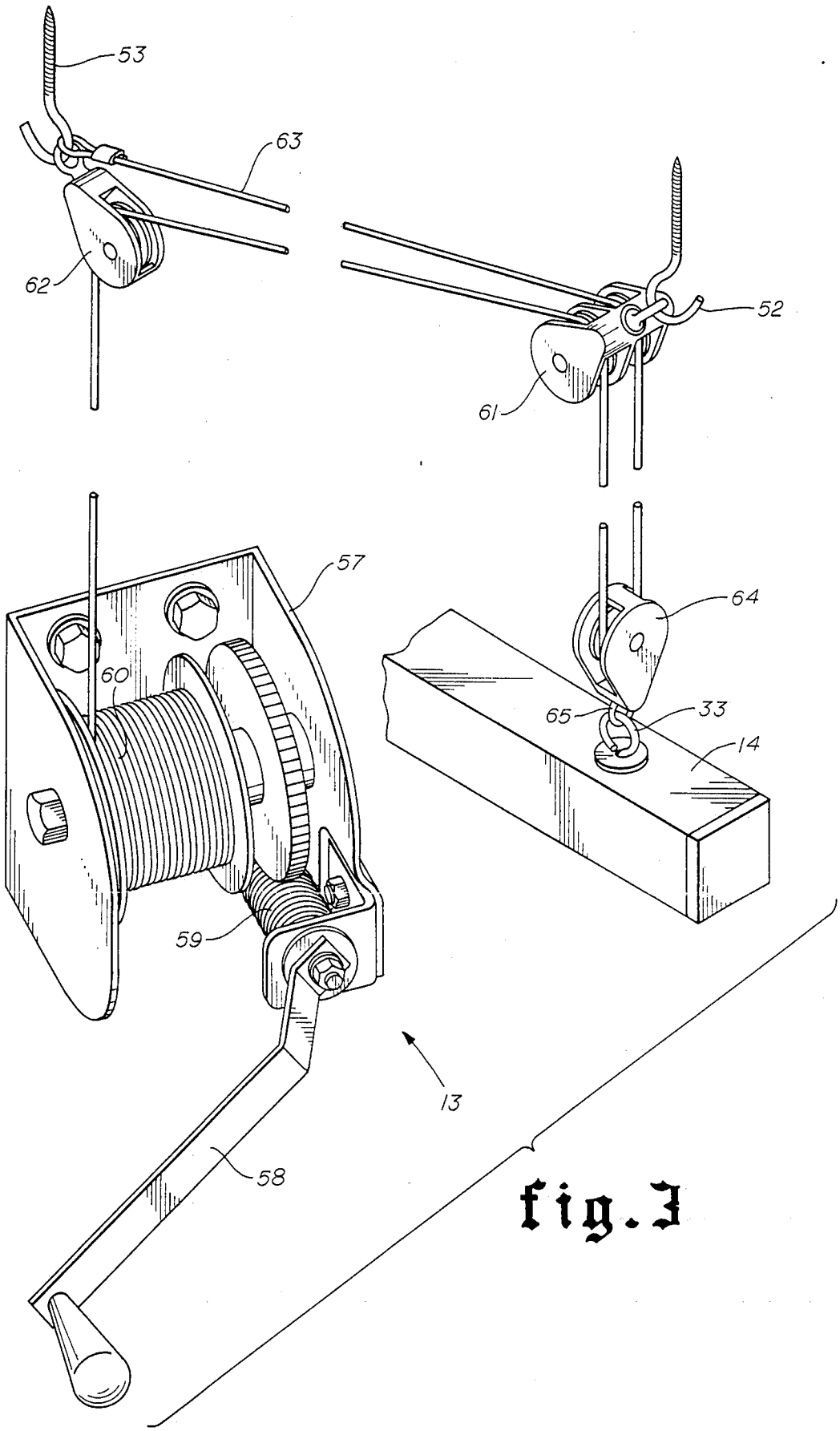
FIG. 3 is an enlarged dimetric view of the hoist components of the lifting device.

The construction of the lifting device is shown in FIG. 2. The lifting device 12 comprises a rectangular longitudinal member 14, and upper and lower rectangular transverse crossbars 15 and 16 respectively. The longitudinal member 14, and crossbars 15 and 16 are constructed of suitable square tubing. The upper crossbar 15 is secured to the top of longitudinal member 14 ear one end by a bracket 17 and screws 18 to extend erpendicularly outward therefrom an equal distance n each side. Member 14 has a felt pad (not shown) on he underside to protect the car top being lifted against amage.

Saddle brackets 19 are pivotally connected near each xtended end of the upper crossbar 15 by bolts 20, vashers 21, and nuts 22. Holes 23 are provided near the nds of the crossbar 15 and mating holes 24 are proided at the top of the saddle bracket 19 to receive the olts 20.

The lower cross bar 16 is placed in the bottom of the addle brackets 19 with holes 25 provided near each end ı alignment with mating holes 26 provided in the sadle brackets 19. Washers 27 are placed on each side of he saddle brackets 19 in axial alignment with the holes 6 and pins 28 are inserted through the holes 25 and 26. 'he shank of each pin 28 is provided with a hole 29 vhich receives a quick release wire retaining pin 30. In his manner, the upper and lower crossbars 15 and 16 re assembled in a vertically parallel position.

The upper crossbar 15 is provided with holes 31 at ach extended end, and the longitudinal member 14 is rovided with holes 32 at its rearward end to receive lift yes 33. The eye portion of the lift eyes 33 extend above ıe crossbar 15 and the longitudinal member 14 and are etained thereon by means of washers 34 and nuts 35.

Pad brackets 36 are secured to the lower crossbar 16 ıwardly of the saddle bracket mounting holes 25 by olts 37, washers 38, and nuts 39. Holes 40 in the crossar 16 and mating holes 41 in the pad brackets 36 reeive the bolts 37. A rubber disk 42 of the type comıonly used for electric buffer machines is secured on ɔp of each pad bracket by bolts 43, nuts 44, and a flat vasher 45.

A third rubber disk 46 is attached in an opposing elation to the other disks on the bottom of longitudinal ıember 14 by a bolt 47, flat washer 48, and nut 49. The olt 47 is received in a hole (not shown) on the bottom urface of the member 14. Nut 49 is inserted inside the ıember 14 to be secured to the bolt 47. A buffer pad 50 f the type commonly used for electric buffer machines ; inserted over the rubber disks 42 and 46 and tightened hereon by draw strings 51. Rubber end caps 52 are ıserted into the open ends of the tubular members.

The hoisting arrangement is best shown in FIGS. 1 nd 3. To position the components correctly, a suitable arage ceiling joist is located, preferably in the center of he parking area, and the automobile is parked in posiion with the top 11 directly underneath the joist. One ırge eye hook 52 is installed in the joist directly above he top 11. A second large eye hook 53 is installed in lignment with hook 52 close to a wall.

A small eye hook 54 is installed approximately 24 ıches on each side of, and in alignment with, the first ırge eye hook 52, or on the next closest ceiling joist. 'he small eye hooks 54 have one end of a short length f safety cable 55 attached thereto, and the other end rovided with a safety latch clip 56. A winch 57 is ıstalled at a suitable height on the wall directly below he second large eye hook 53. The preferred winch 57 is f the type operated by a hand crank 58 which drives a vorm gear 59 to turn the drum 60 to insure against the ıechanism slipping and allowing the top to drop to the round.

A double sheave pulley 61 is installed on the first ırge eye hook 52, and a single sheave pulley 62 is intalled on the second large eye hook 53. One end of a cable 63 is attached to the large eye hook 53 near the wall. The other end of the cable 63 is threaded through one sheave of the double sheave pulley 61, through the sheave of a second single sheave pulley 64, back up through the other sheave of the double sheave pulley 61, and then through the single sheave pulley 62 near the wall, and finally down to be secured to the drum 60 of the winch 57. The second single sheave pulley 64 is provided with a depending hook 65 which is received in the lift eye 33 at the rear of the longitudinal member 14.

OPERATION

Figure 4:
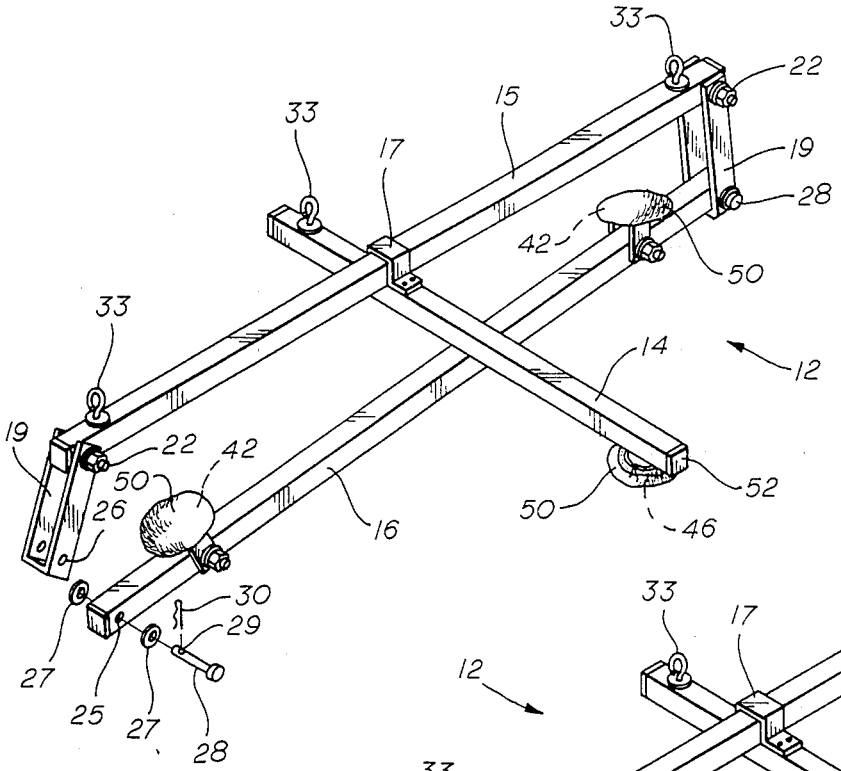
FIG. 4 is an isometric view of the lifting device having one side opened prior to being positioned and secured onto a removable automobile top.
Figure 5:
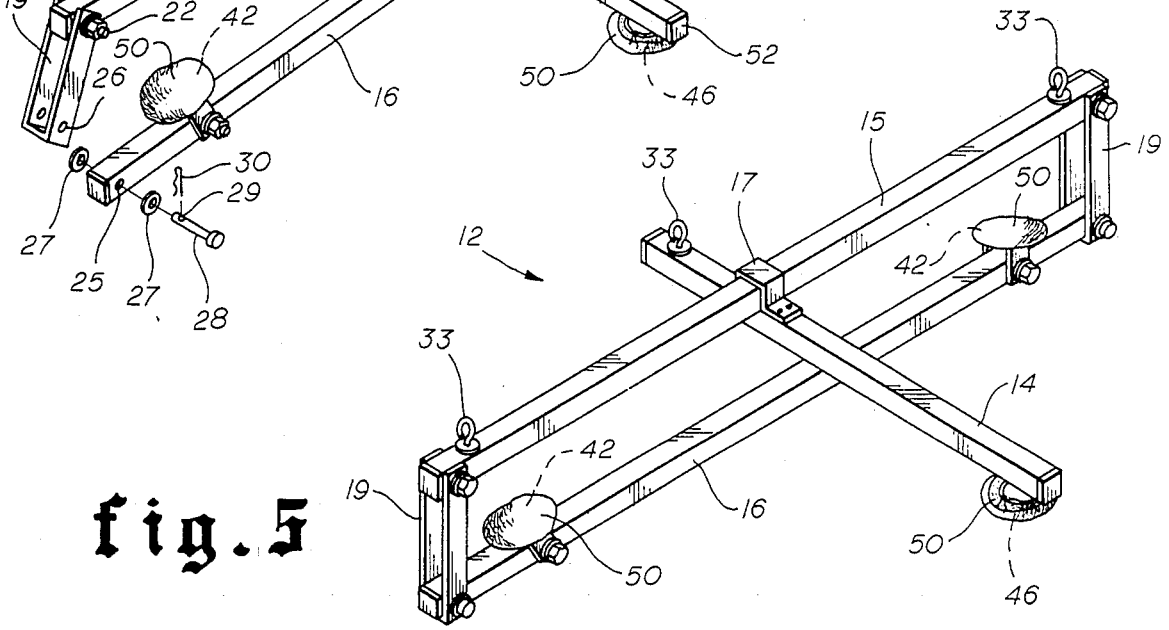
FIG. 5 is an isometric view of the lift device in the closed position.
Figure 6:
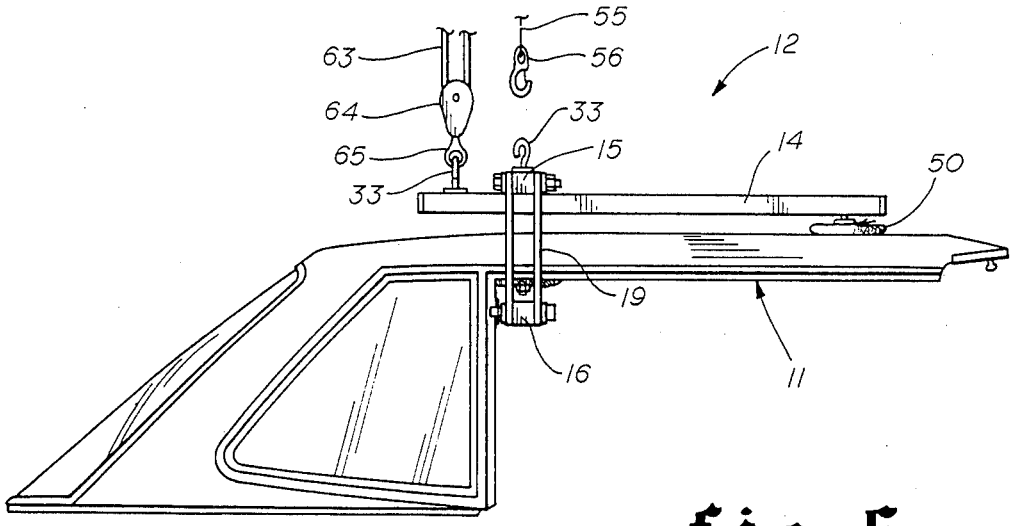
FIG. 6 is a view in side elevation of the lifting device installed on a removable automobile top.

The operation of the apparatus is illustrated in FIGS. 4, 5, and 6. To install the lift device 12 on the automobile top 11, the pin 28 is removed from the saddle bracket 19 on one side, allowing the upper crossbar 15 and the lower crossbar 16 to be separated and the saddle bracket 19 pivotally disposed. The lift device 12 is oriented with single padded disk toward the front of the automobile top. The windows of the automobile are lowered, and the lift device 12 is scissored transversely across the top 11 with the lower crossbar 16 on the inside, and the upper crossbar 15 on the outside of the top 11. The lower crossbar 16 is then reconnected.

In this manner, the padded disk of the longitudinal member 14 is resting on the front of the top, and the padded disks of the lower crossbar 16 are resting against the underside of the top near the rear portion. The depending hook 65 of the second single sheave pulley 64 is inserted into the lift eye 33 at the rear of the longitudinal member 14 and closed to form an eye permanently attached to lift eye 33. After making sure that the cables are straight, the lock handle of the top is released and the winch 57 is turned to slowly raise the top from the automobile.

When the top is raised sufficiently, the safety latch clips 56 of the safety cables 55 are latched into the lift eyes 33 to suspend the top 11 safely from the ceiling of the garage. To reinstall the top, the aforementioned procedure is reversed.

The lift device is designed so that when an upward force is applied to the lift eye 33 at the rear of the longitudinal member 14, a downward force will be applied to the padded disk at the front of the member to prevent the top from pivoting about the transverse axis of support. The location of the lift eye and the crossbars are such that the weight of the top is balanced whereby the top remains horizontal during the lifting and lowering operations. It should be understood that the components of the lift device may be provided in differing lengths to fit various automobile top designs.

While this invention has been described fully and completely with special emphasis upon a preferred embodiment, it should be understood that within the scope of the appended claims the invention may be practiced otherwise than as specifically described herein.

We claim:

1. Apparatus for lifting removable tops from vehicles comprising;

a frame releasably attachable to a vehicle top, said frame having substantially parallel upper and lower members connected together and operable to be positioned with said lower member beneath said top and said upper member above said top, a pair of supporting and lifting members supported in spaced relation along said lower frame member and extending upward therefrom for engaging the underside of the roof portion of said top, at least one member supported on said upper frame member and spaced laterally therefrom for engaging the top of the roof portion of said top, and said pair of supporting and lifting members and said one engaging member being operable on application of an upward lifting force to lift said top and balance the same in an elevated position.

2. A lifting apparatus according to claim 1 in which said one engaging member and said pair of supporting and lifting members have protective pads engageable with the underside and top of said vehicle top.

3. Apparatus for lifting removable tops from vehicles comprising;

a rectangular frame having horizontal upper and lower frame members and vertical end members connected together and openable at one end, a horizontal frame member secured on and extending normal to the midpoint of said upper frame member, a top engaging member secured on the underside on one end of said last named horizontal frame member, and two supporting and lifting members secured on the upper side of opposite end portions of said lower horizontal frame member, said frame being operable to be fitted with said upper frame member over said top and said top engaging member engaging the top of the roof portion of said top and said lower frame member positioned below said top with said supporting and lifting members engaging the underside of the roof of said top on opposite sides thereof, whereby application of an upward lifting force is effective to lift said top and balance the same in an elevated position.

4. A lifting apparatus according to claim 3 including lifting means connectable to said frame on said upper normal extending frame member substantially at the center of gravity of the frame when supporting a vehicle top for lifting the same to an elevated position.

5. A lifting apparatus according to claim 3 in which said top engaging member and said supporting and lifting members have protective pads engageable with the underside and top of the roof of said vehicle top.

6. A lifting apparatus according to claim 3 in which; said normal extending horizontal frame member comprises a longitudinal member of square tubing, said horizontal upper frame member comprises an upper crossbar of square tubing secured to the top of said longitudinal member near one end thereof to extend outward therefrom an equal distance on each side, elongated bracket members pivotally connected near each extended end of said upper crossbar and depending vertically therefrom, said horizontal lower frame member comprises a lower transverse cross bar of square tubing spaced vertically below said upper crossbar and parallel thereto, means for releasably attaching said lower crossbar to said bracket members, a first lift eye secured atop said longitudinal member substantially at the center of gravity of the frame when supporting a vehicle top end, second lift eyes secured atop each extended end o said upper crossbar to receive suspension means and in which said top engaging and lifting and supportin member protective pads comprise;

flexible protective pads attached to and extendin upwardly from the top of said lower crossbar in wardly of said bracket members for engaging th underside of said removable top near the rear por tion, a flexible protective pad attached to and extendin downwardly from the bottom of said longitudina member at its front end for engaging the uppe front surface of said removable top, and said first lift eye, said upper and lower crossbars, an said protective pads being spaced to support sai removable top in a horizontal position upon appli cation of a lifting force to said first lift eye.

7. A lifting apparatus according to claim 6 in which said protective pads comprise a rubber disk covere with a cushioned pad.

8. A lifting apparatus according to claim 3 furthe including suspension means releasably connectable to sai frame for supporting said frame and said top in horizontal elevated position.

9. A lifting apparatus according to claim 8 in which said suspension means comprises a pair of laterally spaced apart eye hooks adapted t be secured to structural ceiling members above sai top, and lengths of cable having one end secured thereto an their other end depending therefrom and provide with releasable attaching means.

10. A lifting apparatus according to claim 3 furthe comprising hoist means adapted to be releasably connected t said frame for raising and lowering said top.

11. A lifting apparatus according to claim 10 in which said hoist means comprises;

a first eye hook adapted to be secured to a structural ceiling member above said top, a double sheave pulley attached thereto, a second eye hook adapted to be secured to a structural ceiling member in horizontal axial alignment with said first hook, a first single sheave pulley attached thereto, a winch adapted to be secured to a structural wall member below said second eye hook, a second single sheave pulley releasably attached t said frame, a length of cable having one end secured to said second eye hook and its other end threaded through one sheave of said double sheave pulley, through the sheave of said second single sheave pulley, through the other sheave of said double sheave pulley, and then through said first single sheave pulley, and secured to the drum of said winch.

12. A system of apparatus for lifting removable tops from vehicles comprising;

a garage having a ceiling and side walls, a frame releasably attachable to a vehicle top, said frame having substantially parallel upper and lower members connected together and operable to be positioned with said lower member beneath said top and said upper member above said top, a pair of supporting and lifting members supported in spaced relation along said lower frame member and extending upward therefrom for engaging the underside of the roof portion of said top, at least one member supported on said upper frame member and spaced laterally therefrom for engaging the top of the roof portion of said top, said pair of supporting and lifting members and said one engaging member being operable on application of an upward lifting force to lift said top and balance the same in an elevated position, means supported on said ceiling for lifting said frame, and means supported on said ceiling for supporting said frame in an elevated position.

13. A system of apparatus according to claim 12 in which said pair of laterally spaced supporting and lifting members engageable with the underside of opposite sides of said top, and said one engaging member and said pair of supporting and lifting members have protective pads engageable with the underside and top of said vehicle top.

14. A system of apparatus according to claim 12 in which said horizontal upper and lower frame members have vertical end members connected together and openable at one end, a horizontal frame member secured on and extending normal to the midpoint of said upper frame member, said top engaging member being secured on the underside on one end of said last named horizontal frame member, and two supporting and lifting members secured on the upper side of opposite end portions of said lower horizontal frame member.

15. A system of apparatus according to claim 14 including means on said upper normal extending frame member cooperable with said lifting means and positioned substantially at the center of gravity of the frame when supporting a vehicle top.

16. A system of apparatus according to claim 14 in which;

said normal extending horizontal frame member comprises a longitudinal member of square tubing, said horizontal upper frame member comprises an upper crossbar of square tubing secured to the top of said longitudinal member near one end thereof to extend outward therefrom an equal distance on each side, elongated bracket members pivotally connected near each extended end of said upper crossbar and depending vertically therefrom, said horizontal lower frame member comprises a lower transverse cross bar of square tubing spaced vertically below said upper crossbar and parallel thereto, means for releasably attaching said lower crossbar to said bracket members, a first lift eye secured atop said longitudinal member substantially at the center of gravity of the frame when supporting a vehicle top end to receive hoist means, second lift eyes secured atop each extended end of said upper crossbar to receive suspension means, and in which said top engaging and lifting and supporting members protective pads comprise;

flexible protective pads attached to and extending upwardly from the top of said lower crossbar inwardly of said bracket members for engaging the underside of said removable top near the rear portion, a flexible protective pad attached to and extending downwardly from the bottom of said longitudinal member at its front end for engaging the upper front surface of said removable top, and said first lift eye, said upper and lower crossbars, and said protective pads being spaced to support said removable top in a horizontal position upon application of a lifting force to said first lift eye.

17. A system of apparatus according to claim 16 in which said protective pads comprise a rubber disk covered with a cushioned cloth pad.

18. A system of apparatus according to claim 14 in which said lifting means comprises hoist means adapted to be releasably connected to said frame for raising and lowering said top.

19. A system of apparatus according to claim 18 in which said hoist means comprises;

a first eye hook secured to said ceiling above said top, a double sheave pulley attached thereto, a second dye hook secured to said ceiling in horizontal axial alignment with said first hook, a first single sheave pulley attached thereto, a winch adapted to be secured to a side wall below said second eye hook, a second single sheave pulley attached to said frame, a length of cable having one end secured to said second eye hook and its other end threaded through one sheave of said double sheave pulley, through the sheave of said second single sheave pulley, through the other sheave of said double sheave pulley, and then through said first single sheave pulley, and secured to the drum of said winch.

20. A system of apparatus according to claim 12 in which said frame comprises;

a rectangular frame having horizontal upper and lower frame members and vertical end members connected together and openable at one end, a horizontal frame member secured on and extending normal to the midpoint of said upper frame member, said top engaging member being secured on the underside on one end of said last named horizontal frame member, two supporting and lifting members secured on the upper side of opposite end portions of said lower horizontal frame member, and said top engaging member and said supporting and lifting members having protective pads engageable with the underside and top of said vehicle top.

* * * * *